US008368498B2

(12) United States Patent
Saito

(10) Patent No.: US 8,368,498 B2
(45) Date of Patent: Feb. 5, 2013

(54) COIL AND METHOD FOR MANUFACTURING THE SAME

(75) Inventor: Makoto Saito, Atsugi (JP)

(73) Assignee: Anritsu Corporation, Atsugi-Shi (JP)

( * ) Notice: Subject to any disclaimer, the term of this patent is extended or adjusted under 35 U.S.C. 154(b) by 0 days.

(21) Appl. No.: 13/352,730

(22) Filed: Jan. 18, 2012

(65) Prior Publication Data

US 2012/0188043 A1 Jul. 26, 2012

(30) Foreign Application Priority Data

Jan. 21, 2011 (JP) ..... 2011-010722

(51) Int. Cl.

| | |
|---|---|
| ***H01F 27/10*** | (2006.01) |
| ***H01F 17/00*** | (2006.01) |
| ***H01F 27/30*** | (2006.01) |
| ***H01F 27/24*** | (2006.01) |
| ***H01F 5/00*** | (2006.01) |

(52) U.S. Cl. ..... 336/105; 336/57; 336/58; 336/206; 336/218; 336/200

(58) Field of Classification Search ..... 336/57, 336/58, 105, 200, 206, 208
See application file for complete search history.

(56) References Cited

U.S. PATENT DOCUMENTS

| | | | | |
|---|---|---|---|---|
| 3,881,244 | A * | 5/1975 | Kendall | 29/602.1 |
| 3,992,691 | A * | 11/1976 | Molthen | 336/200 |
| 5,425,167 | A * | 6/1995 | Shiga et al. | 29/606 |
| 7,339,452 | B2 * | 3/2008 | Lee | 336/200 |
| 7,414,508 | B2 * | 8/2008 | Okuzawa et al. | 336/200 |
| 2003/0070282 | A1 * | 4/2003 | Hiatt et al. | 29/602.1 |
| 2007/0094863 | A1 | 5/2007 | Ogawa et al. | |
| 2010/0182118 | A1 * | 7/2010 | Roskos et al. | 336/200 |

FOREIGN PATENT DOCUMENTS

| | | | |
|---|---|---|---|
| JP | 2008047711 | A | 2/2008 |
| JP | 4317206 | B2 | 5/2009 |

* cited by examiner

*Primary Examiner* — Mohamad Musleh
*Assistant Examiner* — Ronald Hinson
(74) *Attorney, Agent, or Firm* — Pearne & Gordon LLP

(57) ABSTRACT

[Task] There are provided a coil that is simple in structure and excellent in high frequency characteristics and a method for manufacturing the same.

[Means for Resolution] The coil includes a plurality of conductor patterns 11 formed at an interval from each other on a substrate 21, and metal wires 12 that electrically connect an end of one conductor pattern of conductor patterns adjacent to each other with an end of the other conductor pattern that is an end opposite to the end of the one conductor pattern. One or more spiral shapes are formed by two or more conductor patterns 11 and one or more metal wires 12. The coil includes a core material 13 that is arranged at least in a portion inside a space surrounded by one or more spiral shapes to cover the outer peripheries of the metal wires 12 at least over a predetermined range.

9 Claims, 9 Drawing Sheets

(a)

(b)

(a)

(b)

(a)

(b)

(a)

(b)

(c)

COIL AND METHOD FOR MANUFACTURING THE SAME

TECHNICAL FIELD

The invention relates to a coil and a method for manufacturing the same, and particularly, to a coil that can be configured on a circuit substrate and a method for manufacturing the same.

BACKGROUND ART

In recent years, improvements in the speed and capacity of optical communication have been accelerating, and optical communication systems with an extra-large capacity of 40 Gbps have been introduced. Moreover, research and development toward utilization of next-generation 100 Gbps optical communication systems have also been actively performed. A number of inductors (coils) are used as application of a bias T in a high-frequency circuit of an optical transmitter/receiver or a measurement instrument adopted as these optical communication systems, and the demand for coils that are excellent in high frequency characteristics is increasingly growing.

In the bias T to be used in about 10 Gbps optical communication, a small surface-mount-type coil (for example, surface-mount-type coil with a size of about 1.0 mm×0.5 mm) has been used until now. Even if such a coil is used, conspicuous degradation of high-frequency characteristics up to about 10 GHz has not been seen. However, since high-frequency characteristics that are satisfactory up to about 40 GHz are required in a high-frequency circuit to be used for optical communication of 40 Gbps or more, the above surface-mount-type coil cannot be used.

Thus, in order to obtain high impedance in a broad frequency band, a winding type coil with a configuration in which the diameter of the coil changes continuously is proposed (for example, refer to Patent Document 1). Since this constitutes a plurality of different inductors by one coil by gradually increasing the diameter of the coil, the function as an inductor can be favorably exhibited in a very broad frequency band.

However, such a winding type coil has problems in that mounting onto a circuit substrate is difficult, and handling is also not easy. Moreover, such a winding type coil also has problems in that variation of characteristics during mounting, such as occurrence of a difference in characteristics caused by a difference in mounting angle, is large.

Thus, a coil (for example, refer to Patent Document 2) that solves such a problem is also proposed. The coil disclosed in Patent Document 2, which is formed on a substrate including a plurality of layers, includes a transmission line mounted on this substrate, and transmission line patterns that generates inductors, and has a structure in which the transmission line patterns are electrically connected to each other through vias connecting the layers of the substrate so as to become three-dimensional conical inductors.

RELATED ART DOCUMENT

Patent Document

[Patent Document 1] Japanese Patent No. 4317206
[Patent Document 2] JP-A-2008-47711

DISCLOSURE OF THE INVENTION

Problems that the Invention is to Solve

However, the related-art coil disclosed in Patent Document 2 needs to form vias in the substrate, and if the diameter of the coil is intended to be changed in a vertical direction (the thickness direction of the layers), the number of layers of the substrate and the number of the vias increase, and the configuration becomes complicated. On the other hand, if the diameter of the coil in the vertical direction is set to be constant and the diameter of the coil in the lateral direction (direction parallel to the layer surface) is adjusted, the appearance of the coil becomes large in the lateral direction, and the footprint of the coil within the substrate increases. Since this also increases the length of the transmission line for arranging the coil, problems occur in that insertion loss may increase, and ripples caused by the reflection of an input/output signal may occur within the band to be used.

The invention has been made in order to solve such related-art problems, and an object of the invention is to provide a coil that is simple in structure, can be configured on a circuit substrate, and is also excellent in high-frequency characteristics, and a method for manufacturing the same.

Means for Solving the Problems

In order to solve the above problems, a coil of Claim 1 of the invention has a configuration in which the coil includes: a plurality of conductor patterns formed at an interval from each other on a substrate, and metal wires that electrically connect an end of one conductor pattern of conductor patterns adjacent to each other with an end of the other conductor pattern that is an end opposite to the end of the one conductor pattern. One or more spiral shapes being formed by two or more conductor patterns and one or more metal wires. The coil includes a core material that is arranged at least in a portion inside a space surrounded by the spiral shapes and covers the outer peripheries of the metal wires at least over a predetermined range.

Through this configuration, a broadband coil can be configured with simple structure without using vias or the like. Additionally, since a portion of a non-magnetic material of peripheral portions of the metal wires is replaced with a magnetic substance by covering the outer peripheries of the metal wires with the core material, the inductance can be made higher.

Additionally, the coil of Claim 2 of the invention has a configuration in which the inductance of the conductor patterns, the inductance of the metal wires, or the inductance of the conductor patterns and the inductance of the metal wires change gradually.

Through this configuration, the coil that is excellent in high frequency characteristics can be realized as the conductor patterns, the metal wires, or the inductance of the conductor patterns and the inductance of the metal wires change gradually.

Additionally, the coil of Claim 3 of the invention has a configuration in which the core material includes a thermosetting material loaded with a magnetic substance. Through this configuration, the core material can be easily cured after the core material is coated on the substrate.

Additionally, the coil of Claim 4 of the invention has a configuration in which the core material includes a magnetic substance having characteristics as a radar absorbent material.

Through this configuration, since unnecessary waves from an IC or the like can be attenuated by the radar absorbent material that covers the outer peripheries of the metal wires, the back bonding characteristics of the IC or unnecessary bonding to a different IC can be suppressed.

Additionally, the coil of Claim 5 of the invention has a configuration in which a film resistor is formed between the conductor patterns adjacent to each other.

Through this configuration, the influence of a resonant frequency can be reduced.

Additionally, a method for manufacturing a coil of Claim 6 of the invention includes: patterning a plurality of conductor patterns at intervals on a substrate; bonding both ends of a metal line to an end of one conductor pattern of conductor patterns adjacent to each other and an end of the other conductor pattern that is an end opposite to the end, and forming one or more spiral shapes by two or more conductor patterns and one or more metal wires; arranging a liquid core material at least in a portion inside a space surrounded by the spiral shapes; and curing the liquid core material.

Through this method for manufacturing a coil, a broadband coil can be manufactured with simple structure without using vias or the like. Moreover, since a portion of a non-magnetic material of peripheral portions of the metal wires is replaced with a magnetic substance when the outer peripheries of the metal wires are also covered with the core material, the inductance can be made higher.

Additionally, the method for manufacturing a coil of Claim 7 of the invention has a configuration in which the inductance of the conductor patterns, the inductance of the metal wires, or the inductance of the conductor patterns and the inductance of the metal wires change gradually.

Through this configuration, the coil that is excellent in high frequency characteristics can be realized as the conductor patterns, the metal wires, or the inductance of the conductor patterns and the inductance of the metal wires change gradually.

Additionally, the method for manufacturing a coil of Claim 8 of the invention has a configuration in which the core material includes a thermosetting material loaded with a magnetic substance. Through this configuration, the core material can be easily cured after the core material is coated on the substrate.

Additionally, the method for manufacturing a coil of Claim 9 of the invention has a configuration in which the core material includes a magnetic substance having characteristics as a radar absorbent material.

Through this configuration, since unnecessary waves from an IC or the like can be attenuated by the radar absorbent material that covers the outer peripheries of the metal wires, the back bonding characteristics of the IC or unnecessary bonding to a different IC can be suppressed.

Additionally, the method for manufacturing a coil of the invention has a configuration including arranging a film resistor between the conductor patterns adjacent to each other.

Through this configuration, the influence of a resonant frequency can be reduced.

Advantage of the Invention

The invention provides the coil that can be simply mounted on the circuit substrate by first forming the conductor patterns for a coil along with the pattern of the transmission line or the like on the circuit substrate, then electrically connecting the conductor patterns to each other by wire-bonding in the process of wiring a wire, and then coating and curing the core material, and the method for manufacturing the same.

Additionally, in the coil related to the invention, excellent high frequency characteristics can be realized as the conductor patterns, the metal wires, or the inductance of the conductor patterns and the inductance of the metal wires change gradually. Moreover, in the coil related to the invention, a portion of a non-magnetic material of peripheral portions of the metal wires is replaced with a magnetic substance by covering the outer peripheries of the metal wires with the core material. Thus, the inductance can be made higher.

BEST MODE FOR CARRYING OUT THE INVENTION

Figure 1:
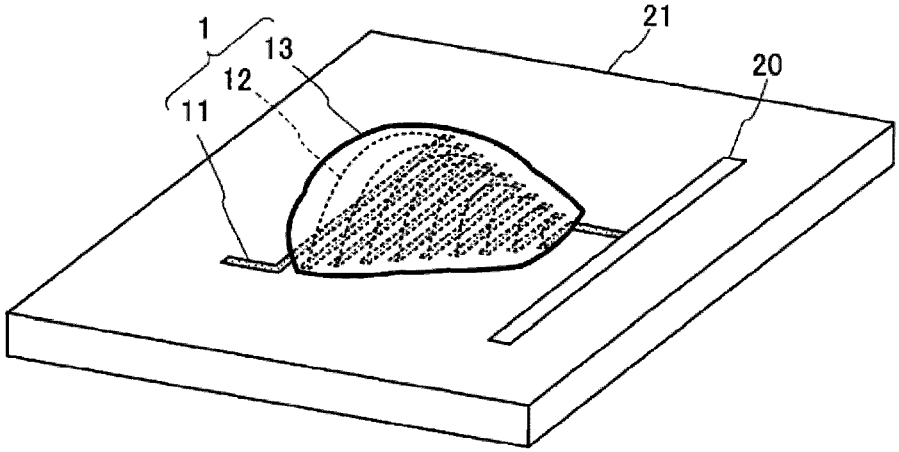
FIG. 1 is a perspective view showing the schematic configuration of a coil related to the invention.
Figure 2:
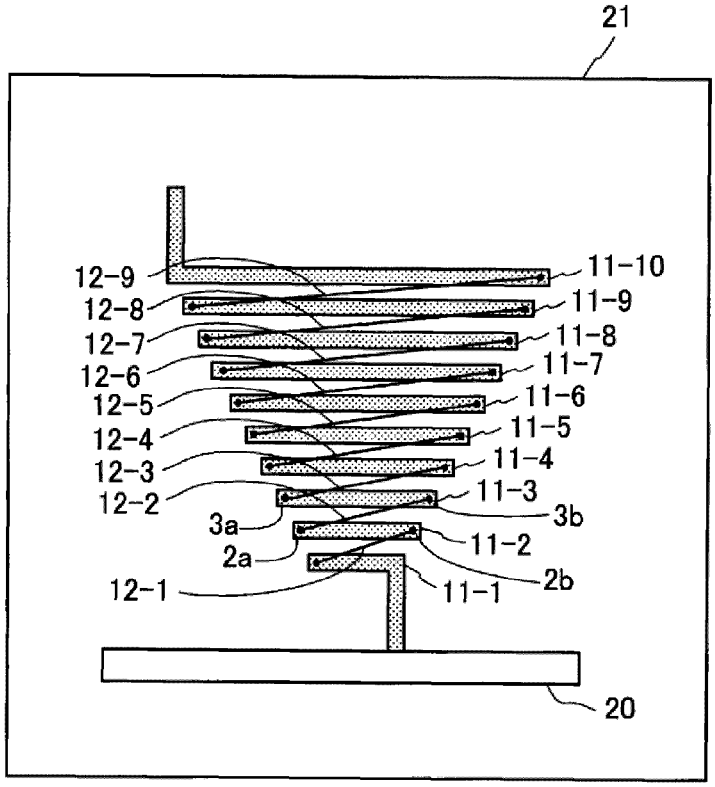
FIG. 2 is a top view showing the schematic configuration of the coil related to the invention.

An embodiment of a coil related to the invention and a method for manufacturing the same will be described below with reference to the drawings. A coil 1 related to the present embodiment is formed on a substrate 21 having a transmission line 20 that transmits a signal for optical communication of, for example, 40 Gbps or more. FIG. 1 is a perspective view showing the schematic configuration of the coil 1 related to the present embodiment, and FIG. 2 is a top view. In addition, dimensional ratios of respective components in respective drawings do not necessarily coincide with actual dimensional ratios.

As shown in FIGS. 1 and 2, the coil 1 related to the present embodiment has a plurality of conductor patterns 11 formed at an interval from each other on the substrate 21, and metal wires (12-*n*) that electrically connect a first end na of one conductor pattern (11-*n*) of conductor patterns (11-*n*) and (11-(*n*+1)) (n is a natural number) adjacent to each other with a second end (n+1)b of the other conductor pattern (11-(*n*+1)) that is an end opposite to the first end na, and has a configuration in which one or more spiral shapes are formed by two or more conductor patterns 11 and one or more metal wires 12.

Moreover, the coil 1 includes a core material 13 that is arranged at least in a portion inside the space surrounded by one or more spiral shapes to cover the outer peripheries of the metal wires 12 at least over a predetermined range.

In addition, in order to avoid the drawings being complicated, in FIG. 2, as for the ends of the conductor patterns 11, only the ends 2*a*, 2*b*, 3*a*, and 3*b* of the conductor patterns 11-2 and 11-3 are designated by reference numerals. For example, a metal wire 12-2 electrically connects the first end 2*a* of the conductor pattern 11-2 with the second end 3*b* of the conductor pattern 11-3. Additionally in FIG. 2, illustration of the core material 13 is omitted. In addition, although the number of the conductor patterns (11-*n*) is illustrated as 10 in FIGS. 1 and 2, this number may be less than 10 or equal to or more than and 11.

One end of the conductor pattern 11-1 is connected to the transmission line 20. Additionally, one end of a conductor pattern 11-10 is connected to a direct-current signal (not shown) or the like. As shown in FIG. 1, the length of the conductor patterns 11 and the length of the metal wires 12 increase continuously as being away from the transmission line 20. In addition, although FIG. 1 shows changing conductor pattern length and wire wiring length, conductor pattern width, wire wiring diameter, or the like may be changed together. Particularly, since the conductor pattern width causes parasitic capacitance, it is better to reduce the pattern width on the side of the transmission line 20. Additionally, the connection between the transmission line 20 and the conductor pattern 11-1 may performed using not a pattern but wire wiring.

That is, the coil 1 has a smaller inductance (high resonant frequency) at a point nearer to the transmission line 20, and has a larger inductance (low resonant frequency) at a point farther from the transmission line 20.

The metal wires 12 are made of metal materials, such as gold, silver, copper, and aluminum. The diameter of the metal wires 12 are about 10 μm to 50 μm. Additionally, the outer peripheries of the metal wires 12 may be subjected to insulating coating using an organic material or the like, and if coating is applied, it is possible to make the interval of metal wires adjacent to each other narrower.

Figure 3:
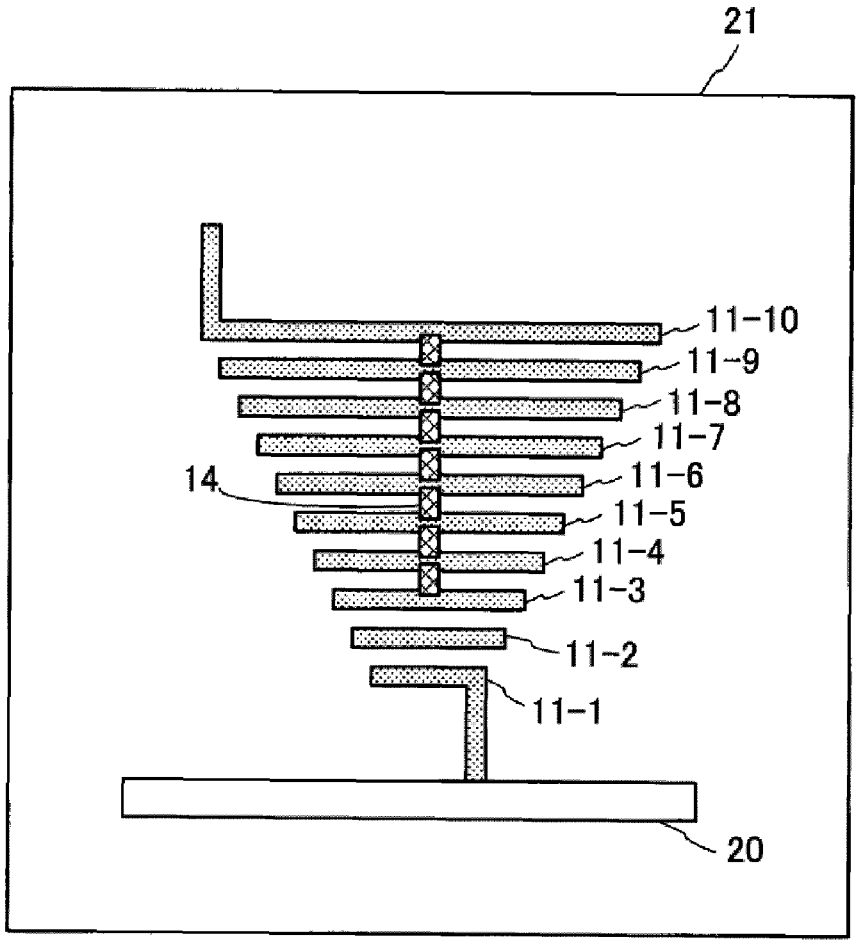
FIG. 3 is a top view showing a configuration in which a film resistor is inserted between conductor patterns.

In addition, since parasitic capacitance is generated between the conductor patterns 11 and GND (back surface of the substrate 21) of the substrate 21, it is desirable to perform selection and design of substrate materials, substrate thickness, conductor pattern width, or the like so that the frequency characteristics that are practically satisfactory within the usable frequency range of an inductor can be obtained. When the usable frequency range is made large under the conditions that the substrate thickness cannot be increased, and the conductor pattern width cannot be reduced, characteristic degradation caused by resonance or the like may occur. In such a case, a film resistor 14 (equal to or less than the resistance value 5 kΩ) is appropriately inserted between the respective conductor patterns 11 as shown in FIG. 3 to perform treatment, such as reducing the influence of the resonant frequency. Additionally, by adjusting the resistance value of each film resistor 14, it is possible to gradually change, for example, the impedance of the coil 1 with the frequency. In this case, a coil capable of correcting frequency characteristics can be realized.

A thermosetting material (epoxy resin, silicon resin, or the like) loaded with a magnetic substance may be used as the core material 13. The core material is not limited to the thermosetting material, and the magnetic substance may have characteristics as a radar absorbent material. Additionally, the electrical characteristics of the core material 13 are appropriately selected in consideration of specific permeability or loss depending on the frequency range to be used. For example, when the loss is made small at about 40 GHz, a material of which the specific permeability is about 2 to 3 will be selected.

Figure 4:
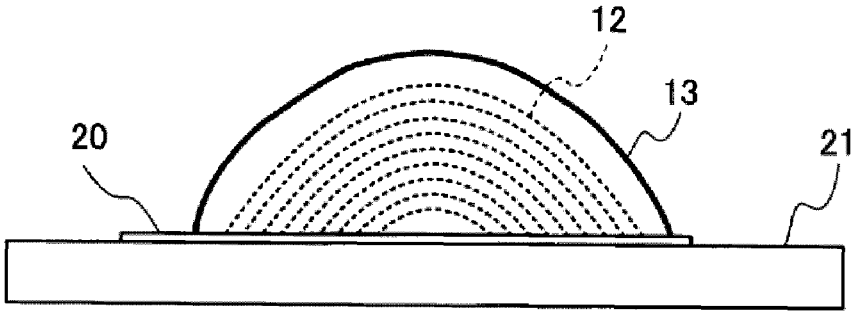
FIG. 4 is a front view when the coil related to the invention is seen from transmission-line side.
Figure 5:
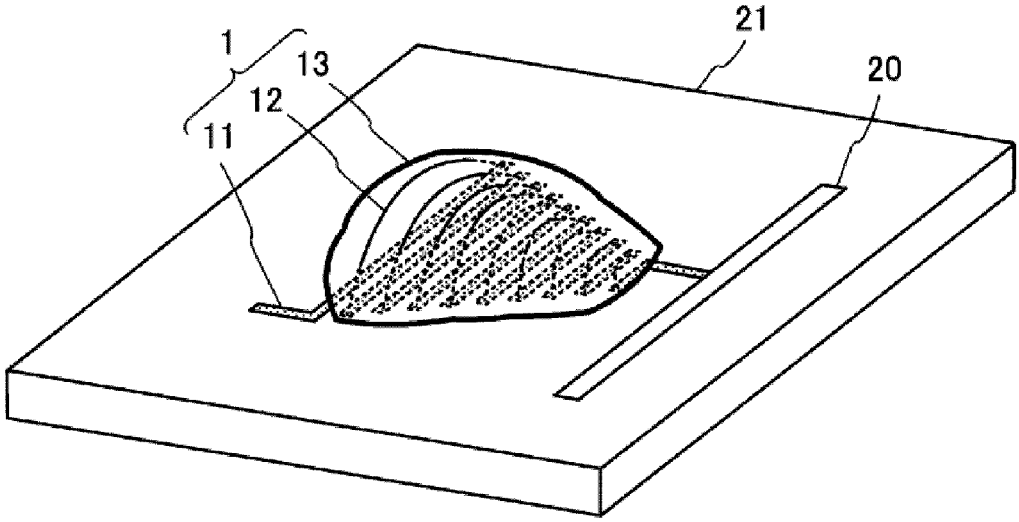
FIGS. 5A and 5B are a perspective view and a front view showing an example of the arrangement of a core material.
Figure 5:
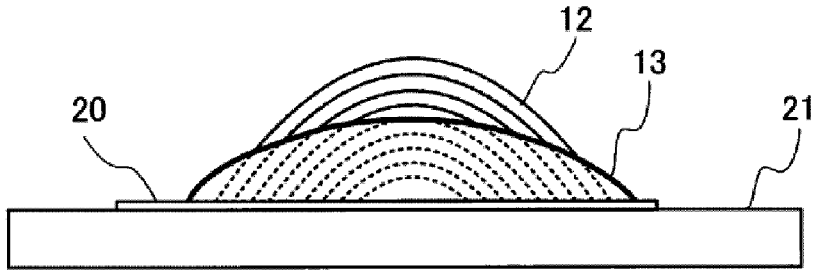
Figure 6:
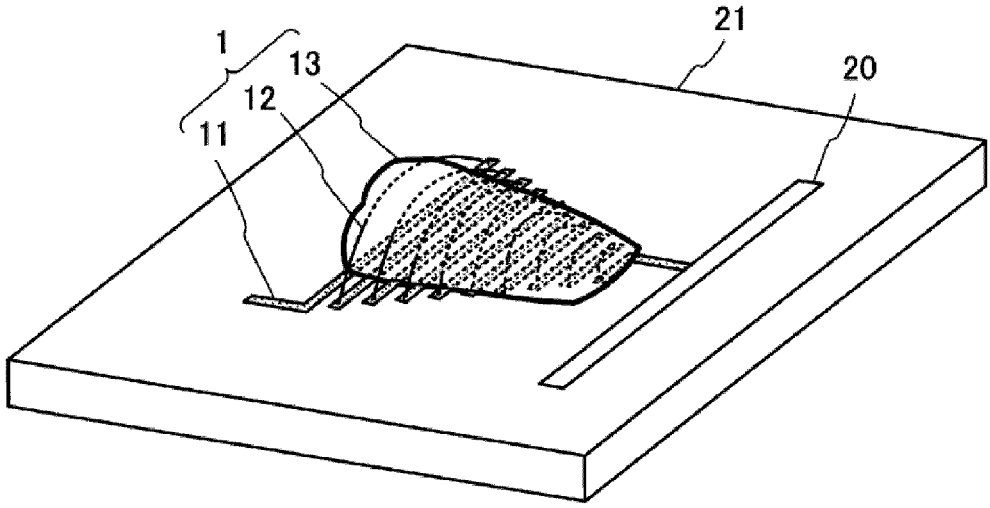
FIGS. 6A and 6B are a perspective view and a front view showing another example of the arrangement of a core material.
Figure 6:
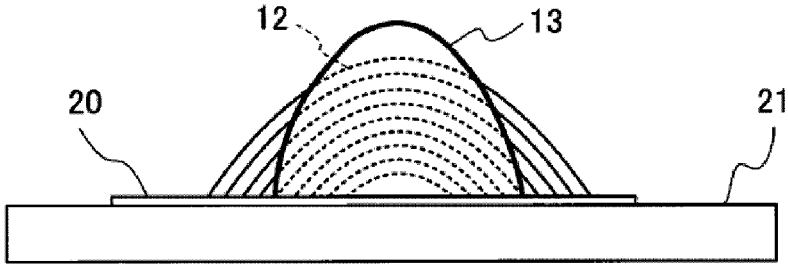

An example of arrangement of the core material 13 is shown below. FIGS. 1, 5A, and 6A are perspective views of the coil 1, and FIGS. 4, 5B, and 6B are front views when the coil 1 is seen from the transmission line 20 side. As shown in the perspective view of FIG. 1 and the front view of FIG. 4, the core material 13 fills the inside of the space surrounded by the conductor patterns 11 and the metal wires 12, and covers a total range of the outer peripheries of the metal wires 12. That is, the core material 13 is arranged so as to stick out from the lateral side and upper side of the coil 1.

Otherwise, as shown in FIGS. 5A and 5B, the core material 13 is arranged at a lower portion of the inside of the space surrounded by the conductor patterns 11 and the metal wires 12, and covers portions of the outer peripheries of the metal wires 12 on the lateral side of the coil 1. That is, the core material 13 is arranged so as to stick out from the lateral side of the coil 1.

Otherwise, as shown in FIGS. 6A and 6B, the core material 13 is arranged at a central portion of the inside of the space surrounded by the conductor patterns 11 and the metal wires 12, and covers portions of the outer peripheries of the metal wires 12 on the upper side of the coil 1. That is, the core material 13 is arranged so as to stick out from the upper side of the coil 1.

In the examples shown in FIGS. 4 to 6B, a predetermined range of the outer peripheries of the metal wires 12 are covered with the core material 13 and a portion of a non-magnetic material of peripheral portions of the metal wires 12 are replaced with a magnetic substance, the inductance can be made higher. Thereby, since a predetermined inductance can also be obtained with fewer turns, the above configuration can be used for the purpose of lowering direct current resistance or for the purpose of improving high frequency characteristics. Additionally, the effect of preventing disconnection or the like of the metal wire 12 can also be expected by covering the outer peripheries of the metal wires 12 with a core material.

Figure 7:
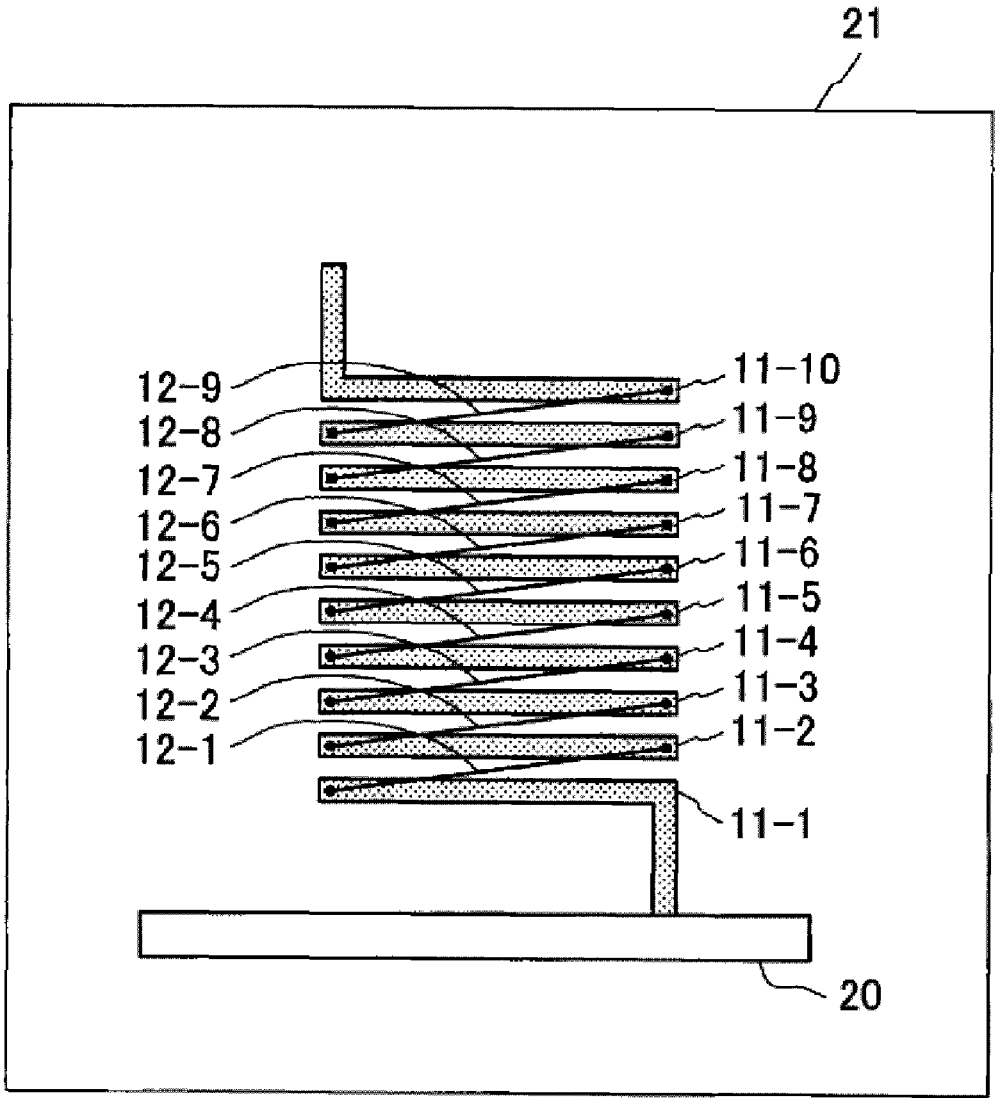
FIG. 7 is a top view showing another configuration example of the conductor patterns.

In addition, although FIG. 2 shows an example in which the length (in the length direction of the transmission line 20) of the conductor patterns (11-*n*) becomes gradually longer as being away from the transmission line 20, as shown in FIG. 7, the length of the respective conductor patterns (11-*n*) may be constant. In this case, the metal wires (12-*n*) is wired so that the length thereof becomes gradually increase as being away from the transmission line 20, for example, as shown in the front view of FIG. 8A. In addition, illustration of the core material 13 is omitted in FIGS. 8A and 8B.

Figure 8:
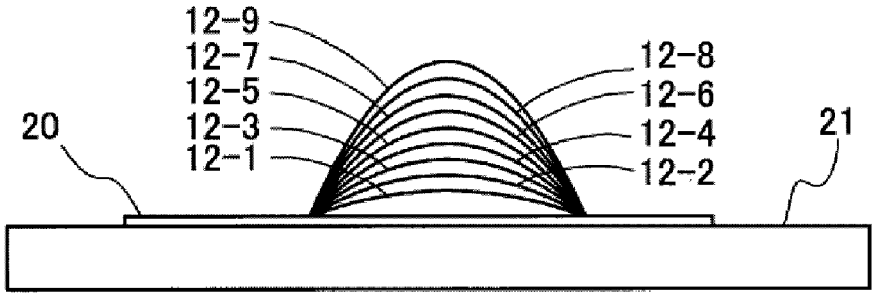
FIGS. 8A and 8B are front views showing an example of the wiring of metal wires.
Figure 8:
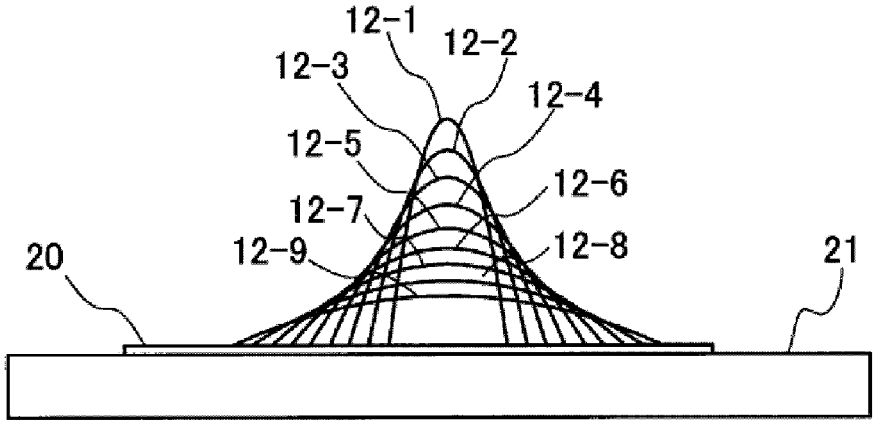

Additionally, in the example shown in FIG. 2 in which the length of the conductor patterns (11-*n*) increases as being away from the transmission line 20, as shown in the front view of FIG. 8B, the length of metal wires (12-*n*) may be constant.

Figure 9:
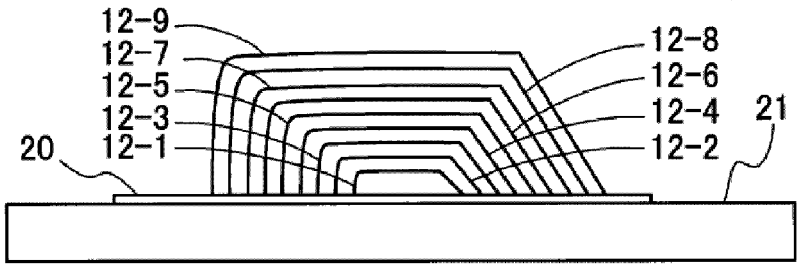
FIGS. 9A, 9B, and 9C are front views showing another example of the wiring of metal wires.
Figure 9:
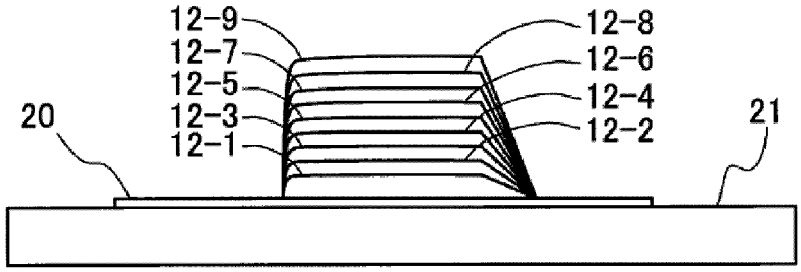
Figure 9:
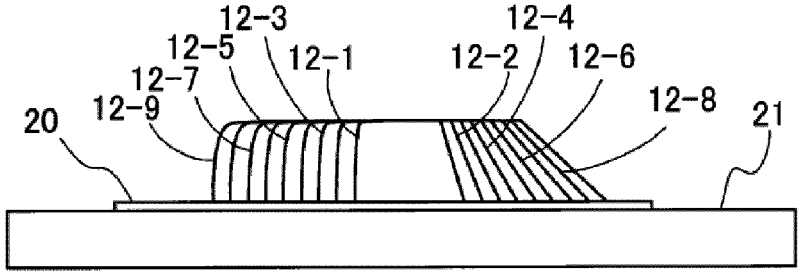

Additionally, although the case where the metal wire 12 is curved is illustrated in FIGS. 4 to 6B and FIGS. 8A and 8B, the shape of the metal wires 12 is not limited to this, and may be arbitrary shapes, such as a trapezoidal shape shown in the front view of FIG. 9. Here, FIGS. 9A and 9C show an example in which the metal wires 12 are wired at the conductor patterns 11 shown in FIG. 2, and FIG. 9B shows an example in which the metal wires 12 are wired at the conductor patterns 11 shown in FIG. 7.

Figure 10:
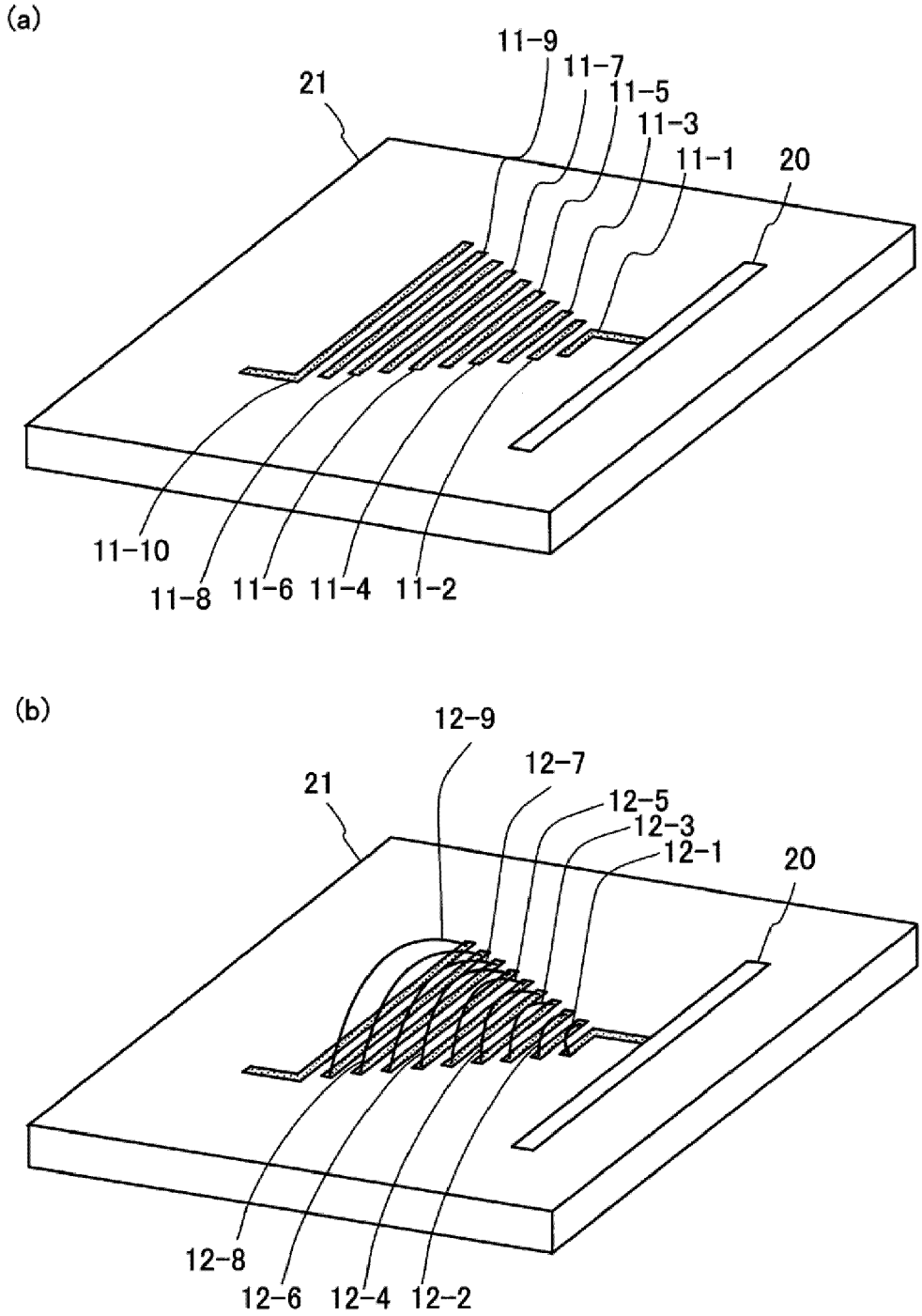
FIGS. 10A and 10B are process charts showing a method for manufacturing a coil related to the invention.

A method for manufacturing the coil 1 related to the present embodiment will be described below with reference to FIGS. 10A to 11. First, in a transmission line substrate manufacturing process, as shown in FIG. 10A, a plurality of conductor patterns (11-*n*) (n is a natural number) along with the transmission line 20 is formed at intervals on the substrate 21.

In addition, as already described, since parasitic capacitance is generated between the conductor patterns 11 and GND (back surface of the substrate 21) of the substrate 21, selection and design of substrate materials, substrate thickness, conductor pattern width, or the like are performed so that the frequency characteristics that are practically satisfactory within the range of usable frequency of an inductor can be obtained. Additionally, in the transmission line substrate manufacturing process, the film resistor 14 (equal to or less than the resistance value 5 kΩ can be appropriately inserted between the respective conductor patterns 11 as shown in FIG. 3 to perform treatment, such as reducing the influence of the resonant frequency. Additionally, the resistance value of each film resistor 14 may be adjusted, and the impedance of the coil 1 may be gradually changed with frequency.

Next, as shown in FIG. 10B, both ends of the metal wire (12-*n*) are respectively bonded to the first end na of any one conductor pattern of the conductor patterns (11-*n*) and (11-(*n*+1)) adjacent to each other and the second end (n+1)b of the other conductor pattern (11-(*n*+1)) that is an end opposite to the first end na. Thereby, one or more spiral shapes are formed by two or more conductor patterns 11 and one or more metal wires 12.

Figure 11:
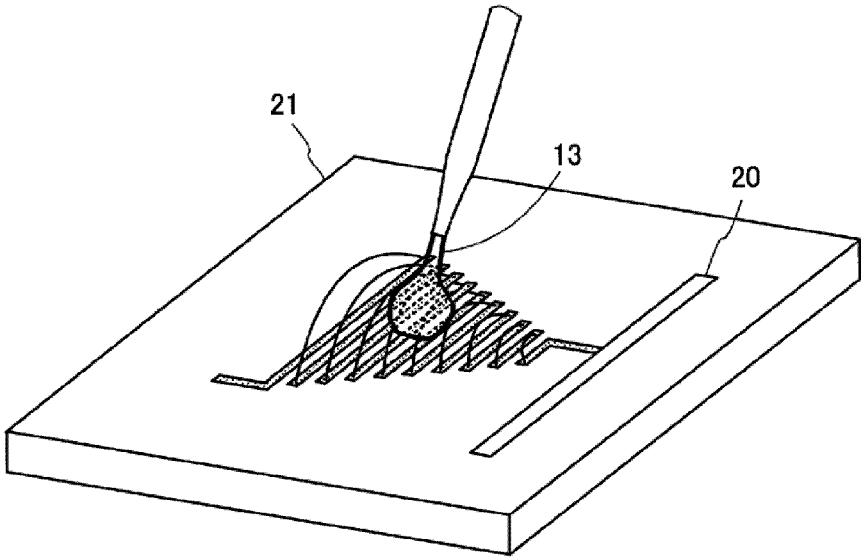
FIG. 11 is a process chart showing a method for manufacturing a coil related to the invention.

Next, as shown in FIG. 11, a liquid core material 13 is poured into the inside of the space surrounded by the one or more spiral shapes. Thereby, the liquid core material 13 is arranged at least in a portion inside the space surrounded by the one or more spiral shapes. Moreover, the outer peripheries of the metal wires 12 may be covered with the liquid core material 13 at least over a predetermined range.

Finally, the poured liquid core material 13 is thermally cured at normal temperature or at a temperature of about 80° C., to complete the coil 1 shown in FIG. 1 or the like.

That is, the above method for manufacturing the coil can simply mount the coil 1 on the substrate 21 by forming the conductor patterns 11 for a coil along with the pattern of the transmission line 20 on the substrate in the transmission line substrate manufacturing process, then electrically connecting the conductor patterns 11 to each other by wire-bonding in the process of wiring a wire, and then coating and curing the core material 13.

The coil 1 manufactured as described above can be used, for example as a well-known coil for a bias T circuit. A usage example is schematically shown in FIG. 12.

Figure 12:
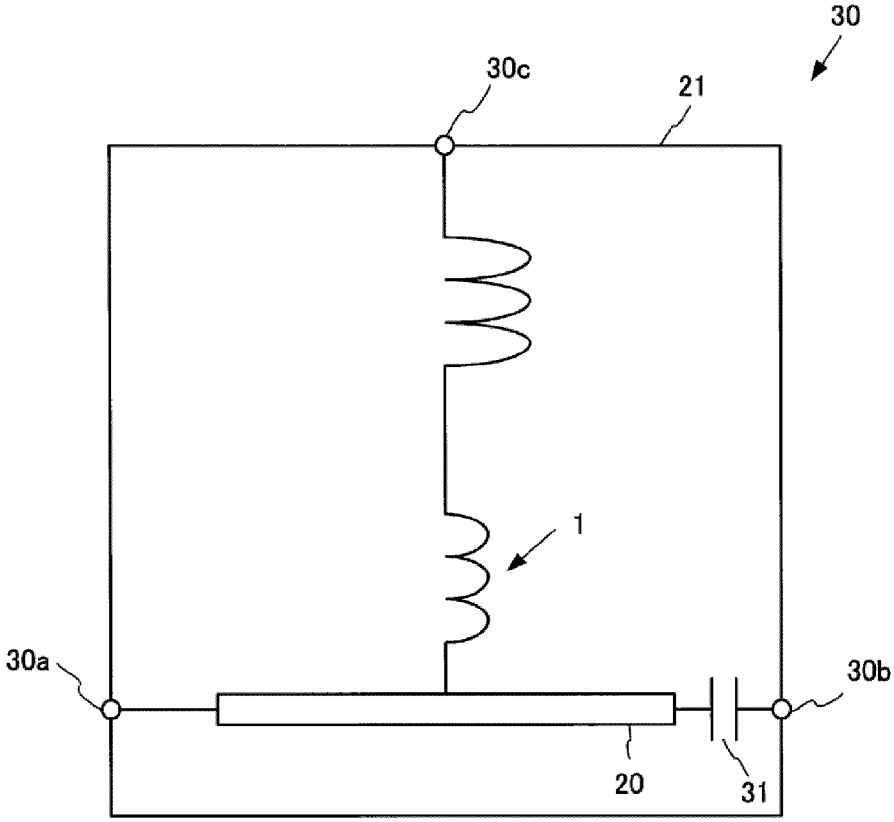
FIG. 12 is a schematic view showing the configuration of a bias T circuit using the coil related to the invention.

As shown in FIG. 12, a bias T circuit 30 includes the coil 1 related to the present embodiment, a capacitor 31, and terminals 30*a*, 30*b*, and 30*c*, on the substrate 21 having the transmission line 20. In FIG. 12, the terminal 30*a* is an alternating-current signal input terminal and a direct-current bias output terminal, the terminal 30*b* is an alternating-current signal output terminal, and the terminal 30*c* is a direct-current bias input terminal. In addition, the capacitor 31 may be arranged at the side of the terminal 30*a* in a place where the terminal 30*b* is intended to be used as a direct-current bias output terminal.

When inductance is insufficient only with the coil 1 as the bias T circuit, a configuration in which a coil with larger inductance is inserted between the coil 1 and the direct-current bias input terminal 30*c* may be inserted.

As described above, in the coil related to the invention and the method for manufacturing the same, an air-core-shaped coil can be formed by the conductor patterns formed on the circuit substrate for a transmission line without using vias, and the metal wires that wire the conductor patterns, and a gradual change in inductance can also be facilitated. Additionally, the inside of the space surrounded by the conductor patterns and the metal wires can be easily filled with the core material by using a liquid core material. Moreover, since a predetermined range of the outer peripheries of the metal wires is covered with the core material, there is an increase in inductors or an effect of preventing disconnection of the metal wires. That is, the invention realizes a coil that is simple in structure, can be configured on a circuit substrate, and is also excellent in high-frequency characteristics, and a method for manufacturing the same.

INDUSTRIAL APPLICABILITY

The coil related to the invention and the method for manufacturing the same are useful as a coil that can be configured on a circuit substrate.

DESCRIPTION OF REFERENCE NUMERALS AND SIGNS

1: COIL
11: CONDUCTOR PATTERN
12: METAL WIRE
13: CORE MATERIAL
14: FILM RESISTOR
20: TRANSMISSION LINE
21: SUBSTRATE
30: BIAS T CIRCUIT
30*a*, 30*b*, 30*c*: TERMINAL
31: CAPACITOR

The invention claimed is:

1. A coil comprising:

a plurality of conductor patterns formed at an interval from each other on a substrate, and metal wires that electrically connect an end of one conductor pattern of conductor patterns adjacent to each other with an end of the other conductor pattern that is an end opposite to the end of the one conductor pattern, one or more spiral shapes being formed by two or more conductor patterns and one or more metal wires, wherein the coil includes a core material that is arranged at least in a portion inside a space surrounded by the spiral shapes and covers the outer peripheries of the metal wires at least over a predetermined range.

2. The coil according to claim 1, wherein the inductance of the conductor patterns, the inductance of the metal wires, or the inductance of the conductor patterns and the inductance of the metal wires change gradually.

3. The coil according to claim 1, wherein the core material includes a thermosetting material loaded with a magnetic substance.

4. The coil according to claim 1, wherein the core material includes a magnetic substance having characteristics as a radar absorbent material.

5. The coil according to claim 1, wherein a film resistor is formed between the conductor patterns adjacent to each other.

6. The coil according to claim 2, wherein the core material includes a thermosetting material loaded with a magnetic substance.

7. The coil according to claim 2, wherein the core material includes a magnetic substance having characteristics as a radar absorbent material.

8. The coil according to claim 2, wherein a film resistor is formed between the conductor patterns adjacent to each other.

9. The coil according to claim 6, wherein the core material includes a magnetic substance having characteristics as a radar absorbent material.

* * * * *